United States Patent [19]

Triplett

[11] Patent Number: 4,876,816

[45] Date of Patent: Oct. 31, 1989

[54] TARGET ILLUMINATING AIMING SYSTEM

[76] Inventor: Melvin W. Triplett, P.O. Box 124, Guthrie, Okla. 73044

[21] Appl. No.: 273,264

[22] Filed: Nov. 18, 1988

[51] Int. Cl.[4] ..... F41G 1/34

[52] U.S. Cl. ..... 42/103; 362/110

[58] Field of Search ..... 42/103, 101; 362/110, 362/111, 112, 113, 114; 33/246

[56] References Cited

U.S. PATENT DOCUMENTS

| | | | |
|---|---|---|---|
| 873,591 | 12/1907 | Penfield | 362/110 |
| 958,332 | 5/1910 | Snyder | 42/103 |
| 1,029,951 | 6/1912 | Seely | 42/103 |
| 1,083,073 | 12/1913 | Ferguson et al. | 362/114 |
| 1,095,686 | 5/1914 | Webb | 362/113 |
| 1,128,739 | 2/1915 | Weigel | 42/103 |
| 1,215,171 | 2/1917 | Lewis | 362/114 X |
| 1,464,382 | 8/1923 | Eaton | 362/110 X |
| 3,656,845 | 4/1972 | Koch-Bossard et al. | 362/110 X |
| 3,826,012 | 7/1974 | Pachmayr | 33/246 |
| 3,898,747 | 8/1975 | Marshall | 42/103 X |
| 4,738,044 | 4/1988 | Osterhout | 362/110 X |

FOREIGN PATENT DOCUMENTS

| | | | |
|---|---|---|---|
| 694560 | 12/1930 | France | 362/110 |
| 463383 | 4/1951 | Italy | 362/110 |

OTHER PUBLICATIONS

Exhibit A–Brochure entitled, "Nationwide Sports Distributors", 1985 publication pp. 7, 9 and 17.

Exhibit B–Brochure entitled, "Cablela's" 1988 publication, p. 122.

*Primary Examiner*—Charles T. Jordan

*Assistant Examiner*—Michael J. Carone

*Attorney, Agent, or Firm*—Dunlap, Codding, Peterson & Lee

[57] ABSTRACT

A target illuminating aiming system, for use with a firing weapon in reduced lighting, is provided with a light assembly for generating light and a light focusing assembly for directing the light generated by the light assembly at a target area into a first zone and a second zone. The second zone generally overlies the first zone and provides sufficient illumination of the target area such that an individual firing the weapon is better able to identify the target area. The first zone is alignable with the trajectory of a projectile fired form the weapon such that the projectile impacts in or near that portion of the target defined by the first zone.

10 Claims, 3 Drawing Sheets

TARGET ILLUMINATING AIMING SYSTEM

FIELD OF THE INVENTION

The present invention relates generally to a target illuminating apparatus for aiming a firing weapon at a target.

DESCRIPTION OF THE PREFERRED EMBODIMENTS

Generally, illuminating aiming devices, such as a laser aiming system, emit a narrow, pencil width laser beam for illuminating a target. The light path emitted by the laser aiming system is adjusted generally to correspond with the trajectory of a projectile fired from a firing weapon. In this way, when the target is illuminated by the laser beam and the weapon is fired the projectile impacts the target generally in or near the illuminated area.

While these types of illuminating systems preform adequately under certain conditions, in a dimly lit environment for example, these target illuminating systems severely limit the users ability to identify and discriminate between targets. This is so because the narrow laser beam illuminates only a very small portion of the target area.

The present invention eliminates these disadvantages by providing an inexpensive and durable target illuminating system for use in reduced lighting. The system of this invention provides a target illumination zone and an aiming zone within the target illumination zone wherein the aiming zone is brighter than the target illumination zone and is alignable with the trajectory of the projectile fired from the weapon. In this way, an individual can simultaneously identify the target while aiming the weapon.

Figure 1:
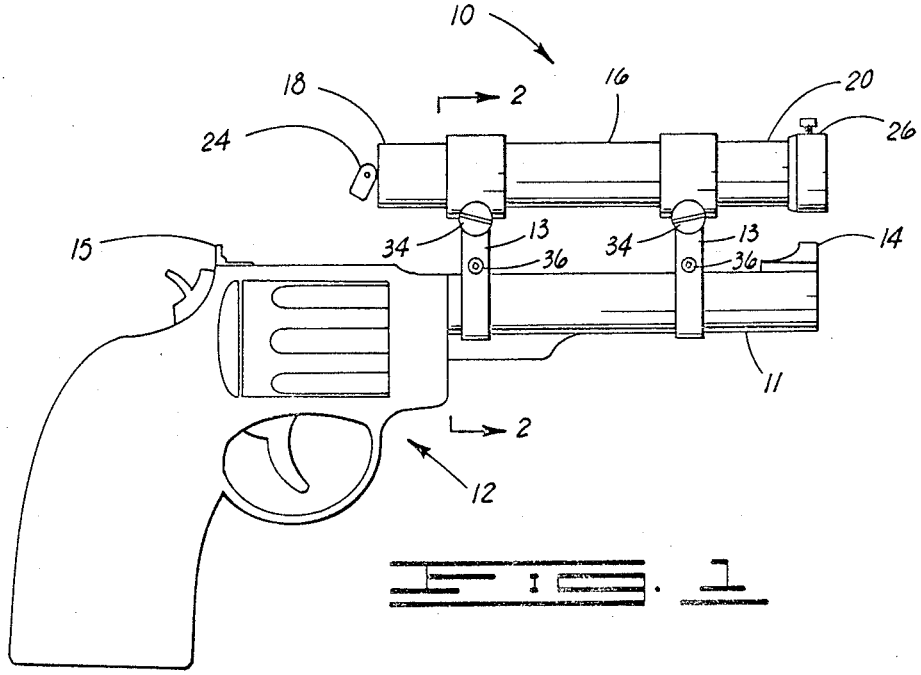
FIG. 1 is a side elevational view of the target illuminating aiming apparatus secured to a firing weapon.

As shown in FIG. 1, and designated herein by the general reference numeral 10, is a target illuminating aiming system, herein referred to as the system, constructed in accordance with the present invention and secured to a barrel 11 of a firing weapon 12 by a pair inverted U-shaped mounts 13. As shown most clearly in FIG. 1, the mounts 13 are spaced apart along the length of the barrel 11 for supporting the system 10 substantially parallel with the barrel 11. The firing weapon 12 also includes a front sight 14 and a rear sight 15 secured to the barrel 11.

The system 10 includes a tubular housing 16, preferably constructed of an electrically conductive material, having a first end 18 and a second end 20 and a housing opening 22 extending through a portion of the tubular housing 16 and intersecting the first end 18 and the second end 20. The system further includes an electrical continuity assembly 24, preferably constructed of an electrically conductive material, secured within the first end 18 and a light focusing assembly 26 secured to the second end 20.

Figure 2:
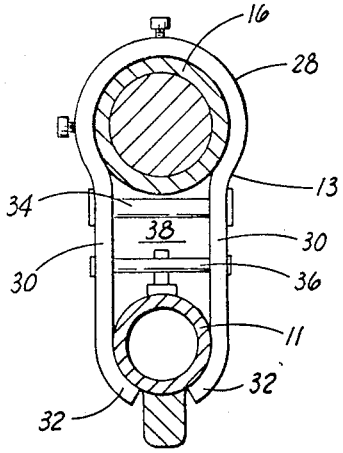
FIG. 2 is a cross-sectional view taken along lines 2—2 of FIG. 1.

Turning now to FIG. 2, each mount 13 includes an expanded upper portion 28 sized for encircling a portion of the housing 16. Each mount 13 also includes a pair of downwardly depending tines 30. Each tine 30 has a lower end 32, inwardly turned for encircling a portion of the barrel 11.

The housing 16 is secured within the upper portion 28 of each mount 13 by an upper compressing member 34 secured across the tines 30 between the housing 16 and the barrel 11. The compressing member 34 is adjusted such that the upper portion 28 is snug against the housing 16.

The system 10, with the mounts 13 attached thereto, is secured to the weapon 12 by positioning the barrel 11 between the tines 30 of each mount 13 and adjusting a lower compressing member 36. The lower compressing member 36, positioned between the upper compressing member 34 and the barrel 11, is adjusted between the tines 30, such that the lower end 32 of each mount 13 snugly overlies a portion of the barrel 11.

The lower compressing member 36 and the upper compressing member 34 are vertically spaced along the tines 30 of each mount 13 such that an opening 38 extends through a portion of each mount 13. In this way, an individual firing the weapon 12 can view the a target while aiming the weapon 12 at the target with the front sight 14 and the rear sight 15.

Figure 3:
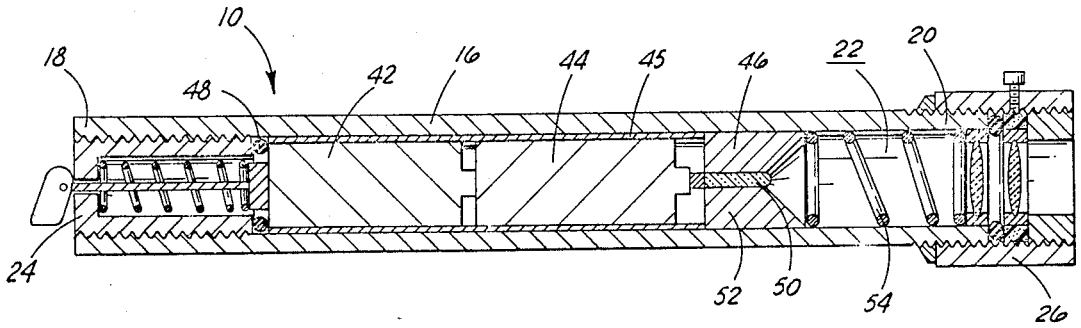
FIG. 3 is a cross-sectional view of the target illuminating aiming apparatus.

Referring now to FIG. 3, the system 10 further includes a first battery 42 and a second battery 44 disposed within a battery housing 45. The battery housing 45 is slidably secured within the housing opening 22 between the electrical continuity assembly 24 and a light assembly 46. The first battery 42 is insulated from the electrical continuity assembly 24 by a first O-ring 48 positioned between the electrical continuity assembly 24 and the first battery 42.

With continued reference to FIG. 3, the light assembly 46 is preferably constructed of an electrically conductive material and is slidably secured within the housing opening 22. The light assembly 46 has a light bulb 50, secured within a reflector 52, for emitting incoherent light through the housing opening 22 and out from the second end 20 of the housing 16. A spring 54, positioned within the housing 16 between the reflector 52 and the light focusing assembly 26, urges the reflector 52 towards the first end 18 of the system 10. In this way the bulb 50 contacts the second battery 44.

Figure 4:
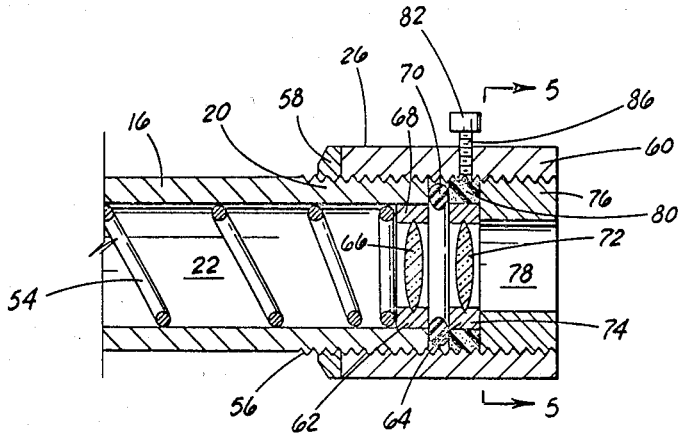
FIG. 4 is an enlarged fragmented cross-sectional view of the second end of the target illuminating aiming apparatus.

Referring now to FIG. 4, the second end 20 has an outer threaded portion 56 for receiving the light focusing assembly 26. The light focusing assembly 26 includes a first threaded lock ring 58 threadedly connected to the threaded portion 56 and a threaded housing 60 secured to the threaded portion 56 of the second end 20 by snugly contacting the first threaded lock ring 58.

The light focusing assembly 26 has a first lens assembly 62 slidably secured within the housing opening 22 and a second lens assembly 64 secured within the threaded housing 60. The first lens assembly 62, having a lens 66 and a lens ring 68, is positioned at the second end 20 between the spring 54 and a second O-ring 70. The second lens assembly 64, having a lens 72 and a lens ring 74 secured thereto, is positioned within the threaded housing 60 between the second O-ring 68 and a second threaded lock ring 76. The second threaded lock ring 76 has an annular opening 78 for allowing light emitted by the light assembly 46 to exit the housing 16 through the housing opening 22 at the second end 20. A resilient material 80, positioned between the threaded housing 60 and the second lens assembly 70, encircles the second lens assembly 64 for a purpose to be discussed below.

Figure 5:
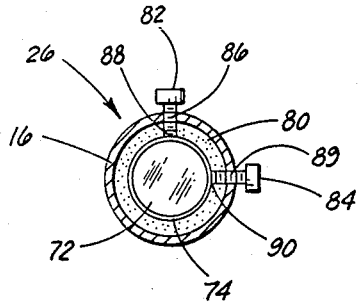
FIG. 5 is a cross-sectional view taken along lines 5—5.

Referring now to FIGS. 4 and 5, the second lens assembly 64 is adjustably secured within the threaded housing 60 by a vertical adjustment screw 82 and a horizontal adjustment screw 84. The vertical adjustment screw 82 is mounted above the second lens assembly 64 to the threaded housing 60 through a vertical bore 86 such that an end 88 of the vertical adjustment screw 82 contacts the lens ring 74. The horizontal adjustment screw 84 is mounted lateral to the second lens assembly 64 to the threaded housing 60 through a horizontal bore 89 such that an end 90 of the horizontal adjustment screw 84 contacts the lens ring 80.

It will now be appreciated that the resilient material 80, supporting the second lens assembly 64 within the threaded housing 60, biases the second lens assembly 64 against the vertical adjustment screw 82 and the horizontal adjustment screw 84. In this way, vertical adjustment and horizontal adjustment of the second lens assembly 64 is achieved by varying the depth of the vertical adjustment screw 82 and the horizontal adjustment screw 84, within the threaded housing 60.

Figure 6:
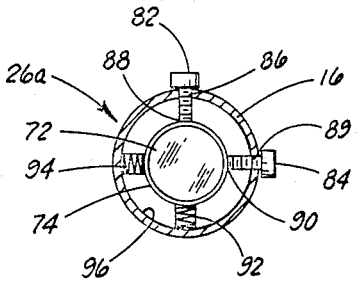
FIG. 6 is a view similar to FIG. 5, but illustrating a modified light focusing assembly.

A modified light focusing assembly 26a is illustrated in FIG. 6. The modified light focusing assembly 26a is constructed exactly like the light focusing assembly 26 except that the resilient material 80 is replaced by a vertical spring 92 and a horizontal spring 94. The vertical spring 92 is positioned opposite the vertical adjustment screw 82 and is secured within the threaded housing 60 between an inner threaded housing surface 96 and the lens ring 74. The horizontal spring 94 is positioned opposite the horizontal adjustment screw 84 and is secured within the threaded housing 60 between the inner threaded housing surface 96 and the lens ring 80.

Figure 7:
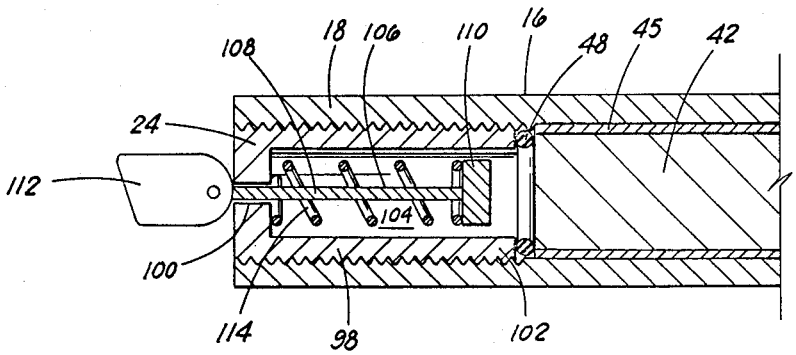
FIG. 7 is an enlarged fragmented cross-sectional view of the first end of the target illuminating aiming apparatus illustrating the a plunger in a first position.
Figure 8:
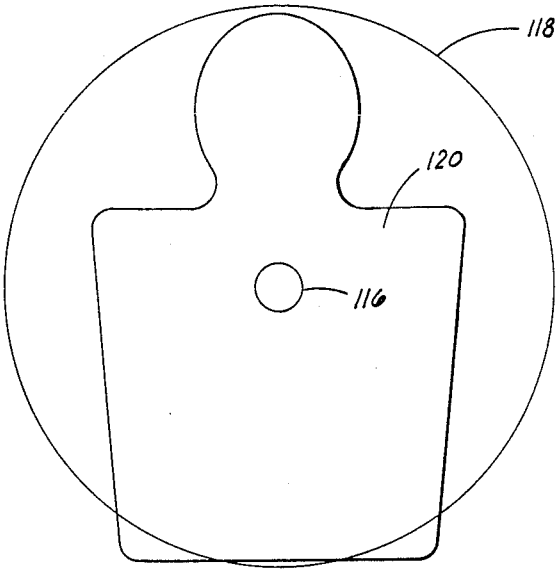
FIG. 8 is the view of FIG. 7 illustrating the plunger in a second position.

Turning now to FIGS. 7 and 8, the electrical continuity assembly 24 includes a threaded housing 98 having a first end 100, a second end 102, a threaded housing opening 104 intersecting the first end 100 and the second end 102, and a plunger 106 slidably secured within the housing opening 104. The plunger 106 includes a stem 108, having a portion thereof extending beyond the first end 100, and a extendable head 110 secured to the stem 108 at the second end 102. The housing opening 104 at the first end 100 is sized for closely receiving the stem 108 and the housing opening 104 at the second end 102 is sized for closely receiving the head 110.

The electrical continuity assembly 24 further includes a cam lever 112 and a compressed spring 114. The cam lever 112 is pivotally secured to the portion of the stem 108 extending beyond the first end 100 for selectively moving the plunger 106 between a first position (FIG. 7) and a second position (FIG. 8). The compressed spring 114, positioned between the first end 100 and the head 110 within the housing 98, provides a biasing force for maintaining the plunger 106 in the selected position.

In this way, when the plunger 106 is in the first position, the plunger 106 is spaced a distance from the first battery 42 thereby interrupting electrical continuity between the light bulb 50 and the first battery 42 and the second battery 44. Conversely, when the plunger 106 is in the second position, the plunger 106 contacts the first battery 42 thereby establishing electrical continuity between the light bulb 50 and the first battery 42 and the second battery 44.

Figure 9:
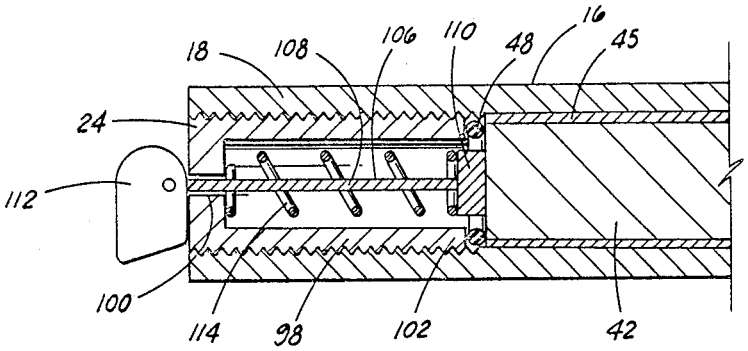
FIG. 9 is a front elevational view of a target area illustrating a target illumination pattern having a first zone and a second zone.

Referring now to FIG. 9, when the plunger 106 is in the second position, the bulb 50 emits light which is reflected by the reflector 52 toward the light focusing assembly 26 and through the housing opening 22 at the second end 20. The light focusing assembly 26 focuses the light such that the light emitted from the system 10 creates a first zone 116 overlaid by a second zone 118 on a target area 120. The first zone 116 and the second zone 120 are further focused by the focusing assembly 26 such that the first zone 116 is brighter than the second zone 120 and the second zone 118 is of sufficient intensity to illuminate the target area 120 such that an individual using the system 10 in reduced lighting is better able to identify the target area 120.

It will now be appreciated that by turning the vertical adjustment screw 82 and the horizontal adjustment screw 84 the first zone 116 may be aligned with the trajectory of a projectile fired from the weapon 12. In this way, the projectile impacts the target area 120 generally in or near the first zone 116. It will be further appreciated that the size and intensity of the first zone 116 and the second zone 118 may be modified by varying the distance between the first lens assembly 62 and the second lens assembly 64.

Figure 10:
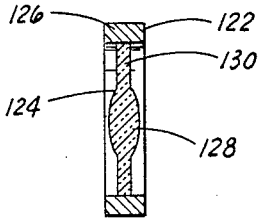
FIG. 10 is a cross-sectional view of a modified lens assembly.

Referring now to FIG. 10, a modified lens assembly 122 is illustrated. The modified lens assembly 122 has a lens 124 and a lens ring 126 secured thereto. The lens 124 has a central convex portion 128 and an outer planer portion 130.

Changes may be made in the construction and operation of the various elements, parts and assemblies described herein without departing from the spirit and scope of the invention as defined in the following claims.

I claim:

1. A target illuminating aiming apparatus for use with a firing weapon adapted to be fired by an individual at a target within a target area comprising:

a housing a first end and a second end with the housing opening extending through a portion thereof and intersecting the first and the second ends of the housing;

means for securing the housing to the firing weapon;

means for generating and emitting light supported within the housing, comprising:

a light for emitting light mounted in the housing opening generally between the first and the second ends of the housing;

a reflector mounted in the housing generally near the light bulb for directly light emitted by the light bulb generally through the housing opening and out from the second end of the housing;

at least one battery mounted in the housing opening, the light bulb emitting light when electrical continuity is established between the light bulb and the battery;

means for selectively establishing electrical continuity between the light bulb and the battery and for interrupting electrical continuity between the light bulb and that battery;

means for focusing said light into at least a first zone and a second zone, wherein the first zone provides an aid for aiming the firing weapon at the target, and wherein the second zone illuminates at least a portion of the target area comprising:

a lens mounted in the housing opening generally near the second end of the housing, the light being emitted from the light bulb and passing through the lens;

means for adjustably moving the lens for adjustably focusing the light emitted from the light bulb, comprising:

a vertical adjustment screw and a horizontal adjustment screw, wherein the vertical adjustment screw is mounted to the housing through a vertical bore such that an end of the vertical adjustment screw extending into the housing contacts the lens for moving the lens in a vertical direction, and wherein the horizontal adjustment screw is mounted to the housing through a horizontal bore such that an end of the horizontal adjustment screw extending into the housing contacts the lens for moving the lens in a horizontal direction;

means for biasing the lens against the vertical adjustment screw and the horizontal adjustment screw; and a resilient material encircling the lens and disposed between the housing and the lens.

2. The apparatus of claim 1 wherein the second zone overlies the first zone.

3. The apparatus of claim 1 wherein the means for securing the housing to the firing weapon comprising a housing mount having an opening extending through a portion thereof whereby the individual firing the weapon can view the target.

4. The apparatus of claim 1 wherein the first zone is brighter than the second zone.

5. The apparatus of claim 1 wherein the second zone is brighter than the first zone.

6. The apparatus of claim 1 wherein the second zone is defined further as being of a sufficient intensity to illuminate the target area surrounding at least a portion of the target whereby the individual firing the weapon is better able to identify the target in reduced lighting.

7. The apparatus of claim 1 wherein the means for focusing the light is defined further a being disposed generally hear the second end of the housing.

8. The apparatus of claim 1 wherein the means for generating light is defined further as generating and emitting incoherent light.

9. The apparatus of claim 1 wherein the means for selectively establishing electrical continuity between the light bulb and the battery and interrupting electrical continuity between the light bulb and the battery comprises: a plunger slidably secured to the first end of the housing for movement between a first position and a second position, such that when the plunger is in the first position, the plunger is spaced a distance from the battery thereby interrupting electrical continuity between the light bulb and the battery and when the plunger is in the second position, the plunger contacts the battery and establishes electrical continuity.

10. The apparatus of claim 1 wherein the means for biasing comprises:

a vertical spring positioned opposite the vertical adjustment screw and disposed between the housing and the lens; and a horizontal spring positioned opposite the horizontal adjustment screw and disposed between the housing and the lens.

* * * * *

UNITED STATES PATENT AND TRADEMARK OFFICE

CERTIFICATE OF CORRECTION

PATENT NO. : 4,876,816

DATED : October 31, 1989

INVENTOR(S) : Melvin W. Triplett

It is certified that error appears in the above-identified patent and that said Letters Patent is hereby corrected as shown below:

Column 5, line 39, "comprising" should be --comprises--.

Column 6, line 14, "a" should be --as--.

Column 6, line 15, "hear" should be --near--.

ABSTRACT, line 10, "form" should be --from--.

Signed and Sealed this

Twenty-second Day of January, 1991

*Attest:*

HARRY F. MANBECK, JR.

*Attesting Officer*

*Commissioner of Patents and Trademarks*